US005513900A

United States Patent [19]

Iglesias

[11] Patent Number: 5,513,900

[45] Date of Patent: May 7, 1996

[54] CHAIR STABILIZING DEVICE

[76] Inventor: Carlos A. Iglesias, 18 Francis St., Apt. #1, Boston, Mass. 02115

[21] Appl. No.: 377,802

[22] Filed: Jan. 24, 1995

[51] Int. Cl.[6] ..... A47C 31/00

[52] U.S. Cl. ..... 297/463.1; 297/326; 248/501

[58] Field of Search ..... 297/463.1, 463.2, 297/344.1, 355, 310, 325, 326, 440.1, 16.1; 248/500, 501, 505, 188, 188.9, 345.1

[56] References Cited

U.S. PATENT DOCUMENTS

| | | | |
|---|---|---|---|
| 316,328 | 4/1885 | Brown . | |
| 326,470 | 9/1885 | Young . | |
| 1,335,842 | 4/1920 | Lambert | 248/501 |
| 1,718,042 | 6/1929 | Hamsing | 297/310 X |
| 1,735,518 | 11/1929 | Van Valkenburg et al. | 297/344.1 X |
| 2,020,230 | 11/1935 | Beisel | 45/137 |
| 2,423,659 | 7/1947 | Rabe | 297/310 X |
| 2,521,422 | 9/1950 | Strand, Jr. | 155/54 |
| 2,850,080 | 9/1958 | Meaney | 297/248 X |
| 2,888,775 | 6/1959 | Thoeming | 248/188.9 |
| 3,664,628 | 5/1972 | Nobel | 248/500 X |
| 3,944,281 | 3/1976 | Pinetti | 297/248 X |
| 4,618,117 | 10/1986 | Gerbe | 248/500 X |
| 4,840,343 | 6/1989 | Gasser | 248/500 |
| 5,114,112 | 5/1992 | Infanti | 248/500 |
| 5,160,105 | 11/1992 | Miller | 248/188.9 |
| 5,234,253 | 8/1993 | LaPointe et al. | 248/501 X |
| 5,251,959 | 10/1993 | DeBraal et al. | 297/344.1 |
| 5,427,342 | 6/1995 | Gagnon | 248/188.9 |

FOREIGN PATENT DOCUMENTS

| | | | |
|---|---|---|---|
| 479783 | 2/1938 | United Kingdom | 248/500 |

*Primary Examiner*—Milton Nelson, Jr.
*Attorney, Agent, or Firm*—Frances P. Craig

[57] ABSTRACT

A chair stabilizing device for rotatable attachment to a ground level, horizontally extending leg member portion of, for example, a lawn or beach chair. The device includes a stabilizing base and a gripping member fixed to the base. A slit in the portion of the gripping member not fixed to the base provides access to a central opening sized and shaped to receive the horizontally extending leg member portion. The gripping member is sufficiently flexible to permit installation of the device by inserting the leg member portion through the slit into the central opening. The gripping member is also sufficiently firm to grip and hold the leg member portion within the central opening and to hold the base parallel to the leg member portion during use of the chair. The base, on installation of the device, extends sufficiently outward to the side of the chair to prevent tipping of the chair to the side during use. A stabilized chair is also disclosed, including, in combination, a chair and the above-described stabilizing device.

16 Claims, 2 Drawing Sheets

CHAIR STABILIZING DEVICE

BACKGROUND OF THE INVENTION

The present invention relates to a device to improve the safety and stability of a chair, for example, a lightweight lawn or beach chair. The invention particularly relates to a stabilizing device for attachment to the base of a chair to prevent sinking in sand or tipping over in sand or uneven surfaces.

The most common type of lawn or beach chair is fabricated with a lightweight, rigid tubular frame, for example, of aluminum or polymeric material, bent and fastened together to provide the legs, seat, back, and, optionally, arm support portions of the chair. The length of the leg portions of the frame may be sufficient for a full height chair or in, e.g., a so-called sand chair, may seat the user quite close to ground level. The back portion of the frame may be in a fixed upright position or it may be positionable at any of several positions from reclining to fully upright. In some designs, commonly termed a chaise longue or lounge chair, the back position is adjustable from upright to horizontal or near-horizontal and an extension is added to the front of the seat portion to provide a leg rest. Most commonly, fabric panels or tubular or fabric webbing, typically of a polymeric material, is stretched, woven, or laced across the seat, back, and, optionally, leg rest portions of the tubing frame to support the seated user. In the most typical designs of chairs of this type, the tubular frame is hinged to permit folding of the chair or chaise longue into a flat profile for portability and storage.

The light weight, comfort, portability, and versatility of these chairs have resulted in widespread use. In particular, their light weight and portability have resulted in great popularity among the elderly and infirm, who may use the chairs indoors as well as outdoors. However, their light weight and foldability can also present a safety hazard, that of being easily tipped over, e.g., sideways. The problem is exacerbated when the chair is resting on deep sand or uneven surfaces. In particular, elderly and infirm users often lean heavily on one arm of a chair to assist them in getting into or getting out of the chair. This can lead to tipping over of the chair, causing to the user to fall and become injured.

It would be desirable to have a way to stabilize such chairs to increase their safety without adding unnecessarily to their weight or interfering with their foldability and portability. The device described herein was developed to address that need.

SUMMARY OF THE INVENTION

In one aspect, the invention is a chair stabilizing device for rotatable attachment to a ground level, horizontally extending leg member portion of a chair. The device includes a stabilizing base and a gripping member fixed to the base. A slit in the portion of the gripping member not fixed to the base provides access to a central opening sized and shaped to receive the horizontally extending leg member portion. The gripping member is sufficiently flexible to permit installation of the device by inserting the leg member portion through the slit into the central opening. The gripping member is also sufficiently firm to grip and hold the leg member portion within the central opening and to hold the base parallel to the leg member portion during use of the chair. The base, on installation of the device, extends sufficiently outward to the side of the chair to prevent tipping of the chair to the side during use.

In alternate embodiments, the chair stabilizing device can include a single gripping member of a length slightly smaller than the length of the leg member portion, or it can include at least two gripping members spaced apart from one another for installation along the length of the leg member portion.

In another aspect, the invention is a stabilized chair including, in combination, a chair and the above-described stabilizing device. The chair includes a seat and a plurality of leg members attached to the seat to support the seat during use of the chair. Optionally, the chair also includes a back attached to the seat and/or a pair of arm rests attached to the seat and/or the back. The seat is positioned approximately horizontally during use of the chair to support a user. At least one of the leg members includes two standards and a horizontally extending portion. Each standard supports the seat at one of two spaced apart points, while the horizontally extending portion joins the standards at ground level. The stabilizing device, as described above, includes a stabilizing base and at least one gripping member fixed to the base. A slit in the portion of the gripping member not fixed to the base provides access to a central opening sized and shaped to receive the horizontally extending leg member portion. The gripping member is sufficiently flexible to permit installation of the device by inserting the horizontally extending leg member portion through the slit into the central opening. The gripping member is also sufficiently firm to grip and hold the horizontally extending leg member portion within the central opening and to hold the base parallel to the horizontally extending leg member portion during use of the chair. The base, on installation of the device, extends sufficiently outward to the side of the chair to prevent tipping of the chair to the side during use.

BRIEF DESCRIPTION OF THE DRAWINGS

For a better understanding of the present invention, together with other objects, advantages, and capabilities thereof, reference is made to the following Description and appended Claims, together with the Drawings in which:

DETAILED DESCRIPTION OF THE PREFERRED EMBODIMENTS

The exemplary embodiments of the stabilizing device described herein and shown in FIGS. 1–4 are not intended to limit the scope of the present invention, but merely to be illustrative and representative thereof.

Figure 1:
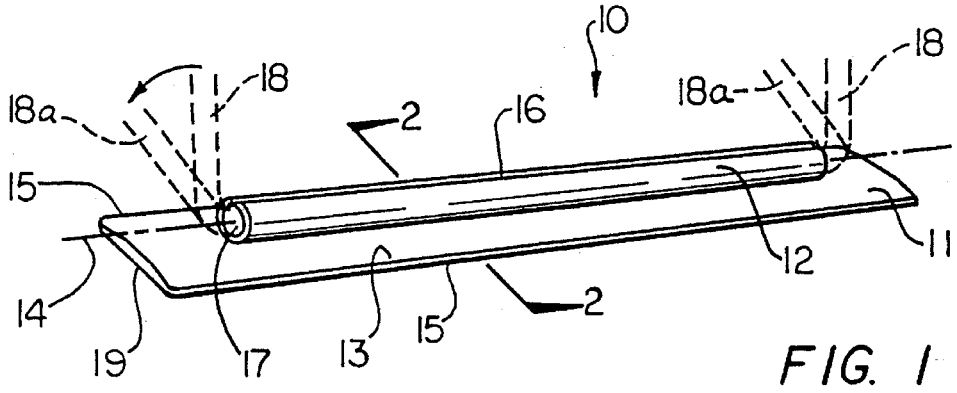
FIG. 1 is a perspective view of a chair stabilizing device in accordance with one embodiment of the present invention.
Figure 2:
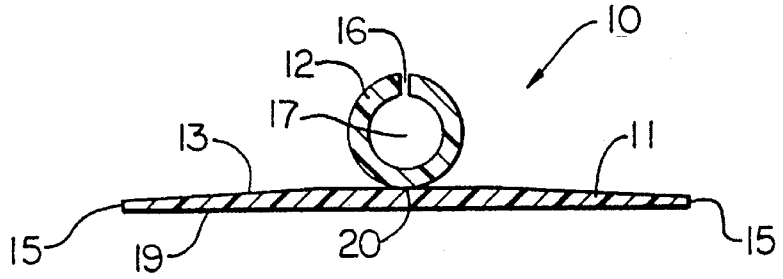
FIG. 2 is a cross-sectional elevational view of the device of FIG. 1, taken along line 2—2.

Referring now to FIGS. 1 and 2, chair stabilizing device 10 includes generally rectangular stabilizing base 11 and clip or gripping member 12 fixed to upper surface 13 of base 11 with its axis 14 (FIG. 1) generally parallel to lengthwise edges 15 of base 11.

Gripping member 12 is tubular and includes slit 16 along its entire length to provide access to cylindrical central opening 17. The diameter of central opening 17 is of a size selected to receive and firmly grip the horizontally extending portion of tubular leg member 18 of a typical folding lawn chair but to permit leg member 18 to rotate therein on application of light pressure, as shown by rotated leg member 18*a* in FIG. 1. This rotatability permits adjustment of the relative positions of chair leg member 18 and stabilizing device 10 to provide stability on uneven ground. The rotatability also permits adjustment of the position of base 11 so that the base can be held generally parallel to leg member 18 when the chair is folded, providing a minimum profile during carrying and storing of the chair.

In the embodiment shown in FIGS. 1 and 2, the length of gripping member 12 is slightly less than the inside distance between the upright standards of leg member 18. The wall thickness of gripping member 12 depends on the innate flexibility and weight of the material of gripping member 12; that is, the preferred wall thickness may be selected to provide a balance between the grip firmness and the weight of the gripping member. A typical wall thickness for gripping member 12 is about 3/16–½ inch.

Gripping member 12 is fabricated from a material having sufficient flexibility to permit leg member 18 to be inserted through slit 16 into central opening 17. However, the material and wall thickness of gripping member 12 must also provide sufficient resilience and firmness to allow member 12 to grip and hold inserted leg member 18 and to resist pullout of the leg member from opening 17 during use of the chair. Additionally, the material preferably is flex cracking resistant, tear resistant, and abrasion resistant. Preferred examples of suitable materials for fabrication of tubular member 12 are natural and synthetic rubbers, silicones, polyvinyl chlorides, and nylons.

Base 11 is generally rectangular in shape. Preferably, its width is selected to provide sufficient friction between lower surface 19 and the surface on which it rests to resist sliding during use of the chair, more preferably about 5–10 inches, most preferably about 6–8 inches. However, its width need only be sufficient for attachment of gripping member 12 and for preventing base 11 from slipping out from under the leg member. Lower surface 19, if desired, may be textured, e.g., ridged, grooved, or treaded, to increase friction between lower surface 19 and the surface on which it rests. The length of base 11 is greater than the outside measurement between upright portions of leg 18, and is selected to provide resistance to sideways tipping of the chair. The length is preferably about 4–15 inches, more preferably about 6–10 inches, greater than the leg member 18 outside measurement. The thickness of base 11 depends on the innate rigidity and weight of the material of base 11; that is, the preferred thickness preferably is selected to provide a balance between the rigidity and weight of the base. A typical thickness for base 11 is about 3/16–¼ inch.

Base 11 is fabricated from a rigid or substantially rigid material, and preferably is resistant to impact, deformation, and abrasion. Preferred examples of suitable materials for fabrication of base 11 are metals, e.g., aluminum; pressed sheet materials and reinforced composites, e.g., fiberboard and waferboard; and rigid and reinforced polymeric materials, e.g., hard rubbers and hard, crosslinked polymers. The properties of the materials of base 11 and tubular member 12 preferably should not be significantly affected by the environmental conditions typically encountered by lawn and beach chairs, including during use of the device in high temperatures and/or on hot sand and exposure to UV radiation, severe weather, and salt water, over the expected life of a lawn chair, about 5–10 years.

Base 11 is shown in FIG. 1 in its preferred configuration, generally planar on its lower surface 19 and slightly arched or thickened in the center of upper surface 13 along the lengthwise direction. Alternatively, base 11 may also be slightly arched in the center of lower surface 19 along the lengthwise direction, with edges 15 lying in a common plane.

Gripping member 12 is fixed to base member 11 at joint 20 by any suitable means that will not interfere with the intended purpose of device 10, for example by adhesives or heat sealing or by mechanical means such as screws, rivets, or staples.

Figure 3:
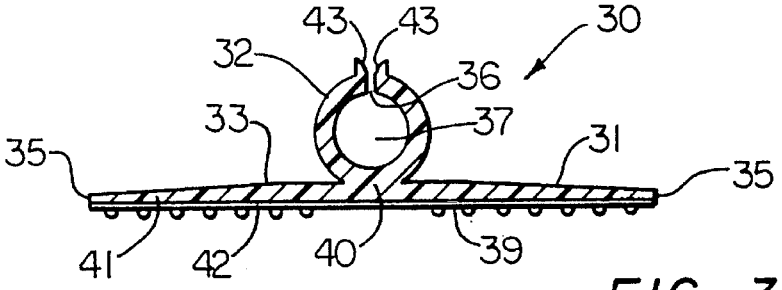
FIG. 3 is a cross-sectional elevation view of a device similar to that shown in FIG. 2, but in accordance with an alternate embodiment of the invention.

FIG. 3 illustrates an alternate embodiment of the stabilizing device of the invention. Stabilizing device 30 includes generally rectangular stabilizing base 31 and gripping member 32. Gripping member 32 is unitary with upper surface 33 of base 31, with its axis generally parallel to lengthwise edges 35 of base 31, in a manner similar to that shown in FIG. 1 for device 10.

Tubular gripping member 32 includes slit 36 along its entire length to provide access to cylindrical central opening 37. The central opening diameter and the wall thickness, length, and material of gripping member 32 are similar to that for gripping member 12 of FIGS. 1 and 2. Base 31 is generally rectangular in shape, and of a width, length, thickness, and material similar to that for base 11 of FIGS. 1 and 2.

Base 31 is shown in FIG. 3 in its preferred configuration, generally planar on its lower surface 39 and slightly arched or thickened in the center of upper surface 33 along the lengthwise direction. Alternatively, base 31 may also be slightly arched in the center of lower surface 39 along the lengthwise direction, with edges 35 lying in a common plane.

Optionally, base 31 may include two layers, upper layer 41 providing upper surface 33 and lower layer 42 providing lower surface 39. Lower layer 42 is fixed to upper layer 41 by any suitable means, for example, an adhesive. Layer 42 may be a slip resistant coating or layer, for example, of a rubber or polymeric material, which may be grooved or treaded, or ridged as shown in FIG. 3, for further slip resistance. Alternatively, upper layer 41 may be less rigid than required, for example of the same material as gripping member 32, and the rigidity described above may be provided by lower layer 42 which is formed from the materials described above for base 11.

Gripping member 32 (or gripping member 12) may include optional guides 43 provided on either side of slit 36. Guides 43 assist mounting of gripping member 32 onto the horizontally extending portion of a chair leg member (not shown) by guiding the horizontally extending leg member portion into central opening 37. Guides 43 may also be configured to provide added firmness to the portion of the tubular wall on either side of slit 36 to more firmly grip the leg member.

As described above, in the embodiment shown in FIG. 3 gripping member 32 is unitary with at least part of base 31. Gripping member 32 may be formed of the same material as upper layer 41, or gripping member 32 and at least part of base 31 may be, for example, co-molded or co-extruded from different polymeric materials, in accordance with known technology. Alternatively, a two layer base, as shown in FIG. 3, may be provided on a stabilizing device having a gripping member separate from the base and fixed thereto, as shown in FIGS. 1 and 2.

Figure 4:
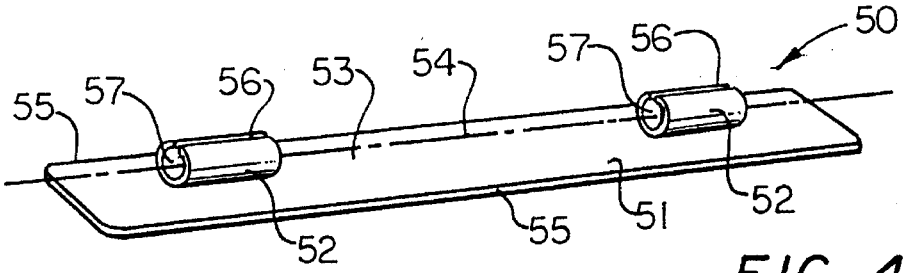
FIG. 4 is a perspective view of a chair stabilizing device in accordance with another embodiment of the invention.

The gripping member need not extend the full length or nearly the full length of the chair leg member inside measurement as shown in FIG. 1. FIG. 4 illustrates an alternate embodiment of the stabilizing device of the invention. Stabilizing device 50 includes stabilizing base 51 and at least two gripping members 52 fixed to surface 53 of base 51 with their common axis 54 generally parallel to lengthwise edges 55 of base 51 in a manner similar to that shown for member 12 in FIG. 1. Each tubular gripping member 52 includes slit 56 along its entire length to provide access to central opening 57. The central opening diameter and the wall thickness, configuration, and material of gripping members 52 are similar to that for gripping member 12 of FIGS. 1 and 2 or member 32 of FIG. 3. The number of gripping members 52 and the length of each are dependent on such factors as their firmness, resiliency, and flexibility, and may be empirically determined based on their ability to firmly grip the chair leg member within opening 57 during use of the chair. Base 51 is generally rectangular in shape, and of a width, length, thickness, configuration and material similar to that described above for base 11 of FIGS. 1 and 2 or base 31 of FIG. 3.

Figure 5:
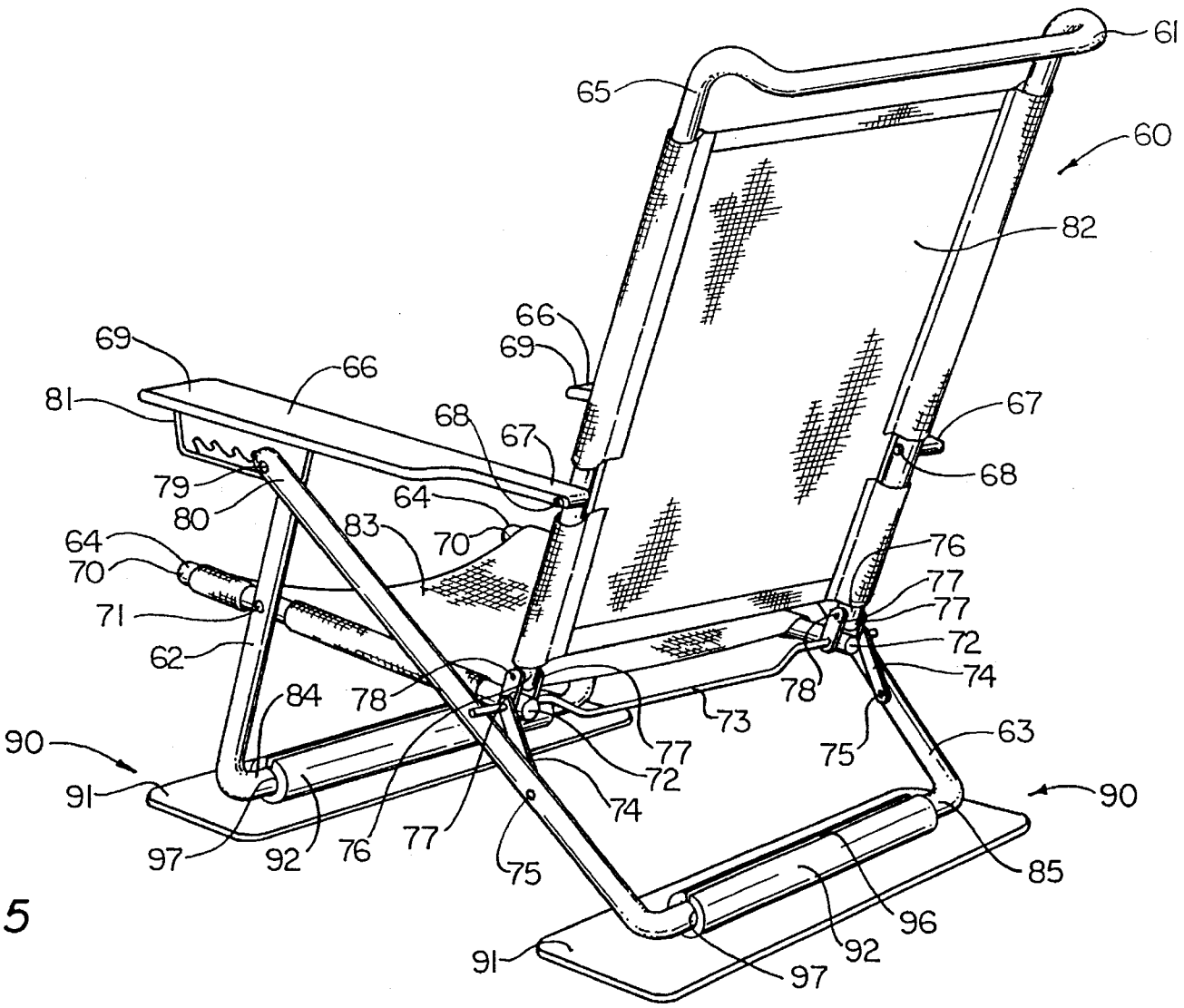
FIG. 5 is a perspective view of a chair including the stabilizing device, in accordance with yet another embodiment of the invention.

In operation, a chair is fitted, prior to use, with at least one, preferably two stabilizing devices mounted on the front and/or rear leg members of the chair, as shown in FIG. 5. FIG. 5 illustrates folding sand chair 60 in which lightweight, rigid tubular frame 61 includes front leg member 62, rear leg member 63, seat member 64, and back member 65, bent and fastened together to form the frame. Alternatively, the frame may be other than tubular; for example, the members of frame 61 may be of solid cylindrical cross section or of solid or hollow oval, rectangular, or other cross section. Arm rests 66 of a rigid material such as wood or plastic are rotatably attached at their rearward ends 67 to back member 65 by armrest pins 68, and at their forward ends 69 to front leg member 62, by additional armrest pins (not shown) to complete the frame, attaining a generally horizontal position for supporting the arms of a user when chair 60 is unfolded.

Front leg member 62 is rotatably attached at seat height to seat members 54 near their front ends 70 by seat pins 71 (only one is shown). Rearward ends 72 of seat members 64 are indirectly supported on rear leg member 63 by horizontally extending support rod 73, maintaining seat members 64 in a near horizontal position when chair 60 is unfolded. Support rod 73 extends across the back of chair 60, rotatably passing through each seat member 64 and resting on each side of rear leg member 63, the center portion of support rod 73 being slightly bent away from contact with the user of the chair. Stabilizing bars 74 are rotatably attached at one end to support rod 73, and are rotatably attached at their opposite ends by stabilizing pins 75 to rear leg member 62. Thus, stabilizing bars 74 assist in folding and unfolding of chair 60.

Back member 65, in addition to being rotatably attached to arm rests 66, is attached at each lower end 76 to two extension bars 77 by back pins 78. Extension bars 77, in turn, are rotatably attached to support rod 73. Thus, back member 65 is indirectly attached to seat members 64 and is indirectly supported on rear leg member 63 by support rod 73. As support rod 73 extends across the back of chair 60 it successively: rests on one upright side or standard of rear leg member 63; rotatably passes through a stabilizing bar 74, an extension bar 77, a seat member 64, and another extension bar 77; passes behind the chair seat; rotatably passes through a third extension bar 77, the other seat member 64, a fourth extension bar 77, and the other stabilizing bar 74; and rests on the opposite upright side or standard of rear leg member 63.

Ratchet pins 79 fixed to forward ends 80 of rear leg member 63 engage ratchet members 81 (only one of each is shown), which are fixed to forward ends 69 of arm rests 66. By manipulating arm rests 66, ratchet members 81 may be repositioned on ratchet pins 79, thus adjusting the angle between back member 65 and seat members 64.

As shown in FIG. 5, the length of leg members 62 and 63 of frame 61 are selected to seat the user quite close to ground level. Alternatively, the leg member length may be sufficient for a full height chair. Woven plastic fabric panels 82 and 83 are fastened around and stretched taut between tubular back member 65 and seat member 64 respectively to support the user during use. Alternatively, tubular or fabric webbing may be woven or laced across seat member 64 and back member 65 in place of fabric panels 82 and 83. Also alternatively, other, known frame configurations may be substituted for that shown for chair 60 of FIG. 5.

The rotatable joints between the various parts of tubular frame 61 and arm rests 66, in cooperation with bars 74 and 77 and rod 73, make it possible to fold chair 60 into a relatively flat profile for portability and storage. However, its light weight and foldability can result in a lack of stability, particularly in the sideways direction. In accordance with the invention, stabilizing devices 90, similar to stabilizing device 10 of FIGS. 1 and 2, are attached to horizontally extending portions 84 and 85 of leg members 62 and 63, respectively. Each of chair stabilizing devices 90 includes a generally rectangular stabilizing base 91 and a gripping member 92 fixed to the upper surface of base 91 in a manner similar to that shown and described above for stabilizing device 10. Gripping member 92 is tubular and includes slit 96 along its entire length to provide access to cylindrical central opening 97. Horizontally extending leg member portions 84 and 85 are each fitted into a gripping member central opening 97 which firmly grips the horizontally extending portion of the leg member but permits the leg member to rotate therein, as described above and shown in FIG. 1 for rotated leg member 18*a*. This rotatability permits adjustment of the relative positions of chair leg members 62 and 63 and stabilizing devices 90 to provide stability on uneven ground. The rotatability also permits adjustment of the position of base 91 so that the base remains generally parallel to leg members 62 and 63 when the chair is folded, providing a minimum profile during carrying and storing of the chair. Base 91 is generally rectangular in shape, with a width selected to provide sufficient friction between lower surface 99 and the surface on which it rests to resist sliding during use of the chair, as described above for device 10. The lower surface of base 91, if desired, may be ridged, grooved, or treaded, as described above for base 31 of device 30, to increase friction between the lower surface and the surface on which it rests. The length of base 91 is greater than the outside measurement between upright portions of leg members 62 and 63, and is selected to provide resistance to sideways tipping of the chair, as described above for device 10. The thickness of base 91 is selected to provide a balance between the rigidity and weight of the base, and provides rigidity or substantial rigidity to the base.

It will be understood by those skilled in this art that alternative embodiments to those specifically described above and illustrated in the Drawings are possible and are within the scope of the invention. For example, the gripping member need not be tubular, but could be provided by such gripping means as metal or plastic clips. The width, number, and placement of the clips as well as their flexibility, firmness, and resilience should be selected to provide the required firm hold and chair leg rotatability described above.

The base is described above and shown in the Figures as a solid plate. Alternatively, the base may be an open structure, for example, a perforated plate, a metal or plastic mesh, or woven wire material, any of which would anchor a chair particularly well in sand. Also alternatively, stabilizing device 90 may be of a configuration similar to any other stabilizing device described above and/or shown in the Figures.

The invention described herein presents to the art novel, improved stabilizing base to improve the safety and stability of a chair such as a lightweight lawn or beach chair. The stabilizing device attaches to the base of such a chair to prevent sinking in sand or tipping over to the side in sand or on uneven surfaces, increasing the safety of the chair without adding unnecessarily to its weight or interfering with its foldability and portability.

While there has been shown and described what are at present considered the preferred embodiments of the invention, it will be apparent to those skilled in the art that modifications and changes can be made therein without departing from the scope of the present invention as defined by the appended Claims.

I claim:

1. A chair stabilizing device comprising:

a generally planar stabilizing base; and at least one gripping member fixed to an upper surface of said base, a portion of said gripping member not fixed to said base having a slit therein communicating with a central opening sized and shaped to receive a ground level, horizontally extending leg member portion of a foldable chair;

wherein said gripping member is flexible to permit installation of said device by inserting said horizontally extending leg member portion through said slit into said central opening, and sufficiently firm to grip and hold said horizontally extending leg member-portion within said central opening and to hold said base parallel to said horizontally extending leg member portion during use of said chair; said base, on installation of said device, extends sufficiently outward to the side of said chair to prevent tipping of said chair to the side during use; and said central opening is sized and shaped to receive said horizontally extending leg member portion rotatably so that, on installation, said device provides stability to said chair on uneven ground and so that said base provides a minimum profile with said chair when said chair is folded.

2. A chair stabilizing device in accordance with claim 1 wherein said base has an abrasion resistant lower surface.

3. A chair stabilizing device in accordance with claim 1 wherein said base has a lower surface including a slip resistant texture.

4. A chair stabilizing device in accordance with claim 1 for installation on a chair in which said horizontally extending leg member portion extends across the width of said chair, wherein the width of said base is selected to be about 4–15 inches longer than the width of a chair on which said device is to be installed.

5. A chair stabilizing device in accordance with claim 4 wherein said gripping member is tubular.

6. A chair stabilizing device in accordance with claim 5 comprising a single gripping member of a length selected to be slightly smaller than the length of the horizontally extending leg member portion of a chair on which said device is to be installed.

7. A chair stabilizing device in accordance with claim 5 comprising at least two gripping members spaced apart from one another for installation along the length of the horizontally extending leg member portion of a chair on which said device is to be installed.

8. A stabilized chair comprising, in combination, a chair comprising:

a seat, said seat being positioned approximately horizontally during use of said chair to support a user; and a plurality of leg members attached to said seat to support said seat during use of said chair, at least one of said leg members including two standards each supporting said seat at one of two spaced apart points and including a horizontally extending portion joining said standards at ground level; and a stabilizing device comprising:

a stabilizing base; and at least one gripping member fixed to said base, a portion of said gripping member not fixed to said base having a slit therein communicating with a central opening sized and shaped to receive said horizontally extending leg member portion;

wherein said gripping member is flexible to permit installation of said device by inserting said horizontally extending leg member portion through said slit into said central opening, and sufficiently firm to grip and hold said horizontally extending leg member portion within said central opening and to hold said base parallel to said horizontally extending leg member portion during use of said chair; and said base, on installation of said device, extends sufficiently outward to the side of said chair to prevent tipping of said chair to the side during use.

9. A stabilized chair in accordance with claim 8 further comprising a back attached to said seat.

10. A stabilized chair in accordance with claim 9 further comprising a pair of arm rests attached to at least one of said seat and said back.

11. A stabilized chair in accordance with claim 8 wherein said stabilizing device base has an abrasion resistant lower surface.

12. A stabilized chair in accordance with claim 8 wherein said stabilizing device base has a lower surface including a slip resistant texture.

13. A stabilized chair in accordance with claim 8 wherein said horizontally extending leg member portion extends across the width of said chair, and said stabilizing device base is about 4–15 inches longer than said chair width.

14. A stabilized chair in accordance with claim 13 wherein said stabilizing device gripping member is tubular.

15. A stabilized chair in accordance with claim 14 wherein said stabilizing device comprises a single gripping member of a length slightly smaller than the length of said horizontally extending leg member portion.

16. A stabilized chair in accordance with claim 14 wherein said stabilizing device comprises at least two gripping members spaced apart from one another for installation along the length of said horizontally extending leg member portion.

* * * * *